US005322576A

United States Patent [19]

Aitken et al.

[11] Patent Number: 5,322,576

[45] Date of Patent: Jun. 21, 1994

[54] VEGETABLE OIL MODIFIED EXPLOSIVE

[75] Inventors: Clare T. Aitken, Brossard; Melvin A. McNicol, Otterburn Park; Robert Lebrun, Beloeil, all of Canada

[73] Assignee: ICI Canada Inc., North York, Canada

[21] Appl. No.: 933,740

[22] Filed: Aug. 24, 1992

[30] Foreign Application Priority Data

Aug. 21, 1991 [CA] Canada ..... 2049628

[51] Int. Cl.[5] ..... C06B 21/00

[52] U.S. Cl. ..... 149/109.6; 149/2; 149/46

[58] Field of Search ..... 149/2, 109.6, 46

[56] References Cited

U.S. PATENT DOCUMENTS

| | | | |
|---|---|---|---|
| 3,447,978 | 6/1969 | Bluhm | 149/2 |
| 4,453,989 | 6/1984 | Mullay | 149/21 |
| 4,472,215 | 9/1984 | Binet et al. | 149/109.6 |
| 4,615,754 | 10/1986 | Miller | 149/109.6 |
| 4,784,706 | 11/1988 | McKenzie | 149/2 |
| 4,790,890 | 12/1988 | Miller | 149/2 |
| 4,820,361 | 4/1989 | McKenzie et al. | 149/2 |
| 4,822,433 | 4/1989 | Cooper et al. | 149/2 |
| 4,889,570 | 12/1989 | Leong | 149/7 |
| 4,911,770 | 3/1990 | Oliver et al. | 149/109.6 |
| 4,931,110 | 6/1990 | McKenzie et al. | 149/2 |
| 4,948,440 | 8/1990 | Cribb et al. | 149/109.6 |
| 4,957,569 | 9/1990 | Waldock et al. | 149/21 |
| 4,999,062 | 3/1991 | Snare et al. | 149/2 |

FOREIGN PATENT DOCUMENTS

| | | |
|---|---|---|
| 1244463 | 11/1988 | Canada . |
| 0331306 | 9/1989 | European Pat. Off. . |
| 0393887 | 10/1990 | European Pat. Off. . |
| 2120228 | 11/1983 | United Kingdom . |

*Primary Examiner*—Edward A. Miller
*Attorney, Agent, or Firm*—Gerald A. Gowan

[57] ABSTRACT

A method of increasing the viscosity, and the resistance to high shear induced crystallization, of a pumpable, shear thickened emulsion explosive, is provided wherein the explosive has been prepared by emulsifying an oxidizer salt phase into a fuel phase, and at least a portion of said fuel phase has been replaced with a vegetable oil. The explosives are particularly suitable for use in up-hole blasting operations because of their high viscosity and resistance to shear induced crystallization of the oxidizer salt.

5 Claims, No Drawings

VEGETABLE OIL MODIFIED EXPLOSIVE

FIELD OF THE INVENTION

This invention is related to emulsion explosives and, in particular, to pumpable emulsion explosives with increased resistance to shear induced crystallization of the oxidizer salt.

DESCRIPTION OF THE RELATED ART

Water-in-fuel emulsion explosives are widely used in the explosives industry due to their low cost, ease of manufacture, and their excellent blasting results. Bluhm, for example, in U.S. Pat. No. 3,447,978, disclosed an emulsion explosive composition comprising an aqueous discontinuous phase containing a dissolved oxidizer salt, a carbonaceous fuel continuous phase, an occluded gas for density reduction, and an emulsifier. Since Bluhm, many further disclosures have been made in this field which have described improvements and variations in water-in-fuel emulsion explosives.

One application where emulsion explosives have been used is in mining operations where, on occasion, it is desirable to fill upwardly inclining boreholes, termed as up-holes, with the emulsion explosive and subsequently detonating the explosive. In this use, the emulsion explosive must be of relatively high viscosity in order to avoid drainage, or leakage, of the explosive from the borehole. However, the explosive composition must also be of a viscosity such that it is pumpable upwardly into the borehole. One method for providing suitable pumping and borehole viscosities, is to subject the emulsion explosive to high shear in order to increase its viscosity. This high shear can be created, for example, by pumping the emulsion explosive formulation through a check valve typically set at up to about 200 psi.

When subjected to these shear forces when being pumped, or when passing through the check valve, typical emulsion explosive tend to become unstable in that the oxidizer salt present in the aqueous phase will crystallize. This crystallization adversely affects the blasting capabilities of the explosive.

Various approaches have been taken in the past in order to overcome the crystallization problem, including increasing the surfactant level by up to 50%. However, it is still desirable to provide a more advantageous and economical method to provide a pumpable emulsion explosive which is responsive to shear induced thickening, while being resistant to shear induced crystallization.

SUMMARY OF THE INVENTION

Accordingly, the present invention provides a method of increasing the shear induced viscosity, and the resistance to high shear induced crystallization, of a pumpable, shear thickenable emulsion explosive, which explosive has been prepared by emulsifying an oxidizer salt phase into a fuel phase, and which method comprises replacing at least a portion of said fuel phase with a vegetable oil.

Preferably, the vegetable oil comprises at least one glyceride, and more preferably, the glyceride is derived from straight chain carboxylic acids having from 3 to 24 carbon atoms. The vegetable oil may comprise a number of different glycerides, and may be saturated or unsaturated. The vegetable oil used may also be a mixture of various vegetable oils.

Preferred vegetable oils include: corn oil, canola oil, soya oil, sunflower oil, linseed oil, peanut oil, and safflower oil, or mixtures thereof.

The compositions of various oils, typical of oils of use in the present invention are shown in Table 1, although other oils may also be used.

The vegetable oil may be used to replace all or part of the fuel used in the emulsion explosive depending on the degree of resistance to shear induced crystallization which is desired. Preferably, vegetable oil comprises at least 30% of the fuel phase of the emulsion explosive. More preferably, the fuel phase comprises between 30 and 704, by weight of the fuel phase, of a vegetable oil.

The emulsion explosives of the present invention may be heated in order to improve the liquidity of the composition in order to improve pumpability. However, the emulsion explosives of the present invention are pumpable at a temperature of less than 40° C., and more preferably, at a temperature less than 25° C.

TABLE 1

| | Vegetable Oil Composition | | | | | | |
|---|---|---|---|---|---|---|---|
| Fatty Acid | Canola | Peanut | Sunflower | Corn | Soybean | Safflower | Olive |
| Palmitic | 4.0% | 8.3% | 6.4% | 8–12% | | 6.4% | 9.4% |
| Stearic | 1.5 | 3.1 | 1.3 | 2.5–4.5 | | 3.1 | 2.0 |
| Oleic | 58.0 | 56.0 | 21.3 | 19–49 | 26% | 13.4 | 83.5 |
| Linoleic | 22.0 | 26.0 | 66.2 | 34–62 | 49 | 76.6–79 | 4.0 |
| Linolenic | 10.0 | | <0.1 | | 11 | 0.04–0.13 | |
| Arachidic | 0.8 | 2.4 | 4.0 | | | 0.2 | 0.9 |
| Eicosenoic | 2.0 | | | | | | |
| Behenic | 0.3 | 3.1 | 0.8 | | | | |
| Erucic | 1.0 | | | | | | |
| Lignoceric | | 1.1 | | | | | |
| Myristic | | | | 0.1–1.7 | | | |
| Hexadecenoic | | | | 0.2–1.6 | | | |
| Saturated Acids | | | | | 14 | | |

While the use of vegetable oils in emulsion explosives has been described in the prior art as merely being one of a variety of suitable oils which may be used as a fuel in emulsion explosives in general, the beneficial effects of increased viscosity and resistance to shear induced crystallization, observed in the pumpable, shear thickened formulations of the present invention, have not been described.

Prior to pumping, the emulsion explosives of the present invention have similar properties as emulsions of the prior art. When subjected to high shear forces such as, for example, passing through a 100 to 200 psi. check valve, the viscosity of the composition rapidly increases to levels where the explosive is sufficiently thick to remain stationary in the borehole, without leakage. The explosive also has increased resistance to shear induced crystallization of the oxidizer salt, under these conditions.

Accordingly, the present invention also provides a method of manufacturing a pumpable, shear thickened emulsion explosive as described hereinabove, comprising:

emulsifying a liquefied oxidizer salt into a fuel phase to form an emulsion explosive premix; and subjecting said emulsion explosive premix to high shear to produce a high viscosity emulsion explosive, characterized in that said fuel phase comprises a vegetable oil.

The oxidizer salt for use in the discontinuous phase of the emulsion is preferably selected from the group consisting of alkali and alkaline earth metal nitrates, chlorates and perchlorates, ammonium nitrate, ammonium chlorates, ammonium perchlorate and mixtures thereof. It is particularly preferred that the oxidizer salt is ammonium nitrate, or a mixture of ammonium and sodium nitrate.

A preferred oxidizer salt mixture comprises a solution of about 69% ammonium nitrate, 15% sodium nitrate and 16% water.

The oxidizer salt is typically a concentrated aqueous solution of the salt or mixture of salts. However, the oxidizer salt may also be a liquefied, melted solution of the oxidizer salt where a lower water content is desired.

The oxidizer salt-containing discontinuous phase of the emulsion explosive may also be a eutectic composition. By eutectic composition it is meant that the melting point of the composition is either at the eutectic or in the region of the eutectic or the components of the composition.

The oxidizer salt for use in the discontinuous phase of the emulsion may further comprise a melting point depressant. Suitable melting point depressants for use with ammonium nitrate in the discontinuous phase include inorganic salts such as lithium nitrate, silver nitrate, lead nitrate, sodium nitrate, potassium nitrate; alcohols such as methyl alcohol, ethylene glycol, glycerol, mannitol, sorbitol, pentaerythritol; carbohydrates such as sugars, starches and dextrins; aliphatic carboxylic acids and their salts such as formic acid, acetic acid, ammonium formate, sodium formate, sodium acetate, and ammonium acetate; glycine; chloracetic acid; glycolic acid; succinic acid; tartaric acid; adipic acid; lower aliphatic amides such as formamide, acetamide and urea; urea nitrate; nitrogenous substances such as nitroguanidine, guanidine nitrate, methylamine, methylamine nitrate, and ethylene diamine dinitrate; and mixtures thereof.

Typically, the discontinuous phase of the emulsion comprises 60 to 97% by weight of the emulsion explosive, and preferably 85 to 954 by weight of the emulsion explosive.

The continuous water-inniscible organic fuel phase of the emulsion explosive of the present invention comprises a vegetable oil as described hereinabove. However, the vegetable oil may be mixed with a variety of other organic fuels which are typically used in the manufacture of emulsion explosives. Suitable organic fuels for use in the continuous phase include aliphatic, alicyclic and aromatic compounds and mixtures thereof which are in the liquid state at the formulation temperature. Suitable organic fuels may be chosen from fuel oil, diesel oil, distillate, furnace oil, kerosene, naphtha, waxes, (eg. microcrystalline wax, paraffin wax and slack wax), paraffin oils, benzene, toluene, xylenes, asphaltic materials, polymeric oils such as the low molecular weight polymers of olefins, animal oils, fish oils, and other mineral, hydrocarbon or fatty oils, and mixtures thereof. Preferred organic fuels are liquid hydrocarbons, generally referred to as petroleum distillate, such as gasoline, kerosene, fuel oils and paraffin oils. More preferably the organic fuel is paraffin oil.

Typically, the continuous water-immiscible organic fuel phase of the emulsion explosive comprises 3 to 30% by weight of the emulsion explosive, and preferably 5 to 15% by weight of the emulsion explosive.

The emulsion explosive comprises an emulsifier component to aid in the formation to the emulsion, and to improve the stability of the emulsion. The emulsifier component may be chosen from the wide range of emulsifying agents known in the art to be suitable for the preparation of emulsion explosive compositions. Examples of such emulsifying agents include alcohol alkoxylates, phenol alkoxylates, poly(oxyalkylene) glycols, poly(oxyalkylene) fatty acid esters, amine alkoxylates, fatty acid esters of sorbitol and glycerol, fatty acid salts, sorbitan esters, poly(oxyalkylene) sorbitan esters, fatty amine alkoxylates, poly(oxyalkylene)glycol esters, fatty acid amides, fatty acid amide alkoxylates, fatty amine, quaternary amines, alkyloxazolines, alkenyloxazolines, imidazolines, alkyl-sulfonates, alkylarylsulfonates, alkylsulfosuccinates, alkylphosphates, alkenylphosphates, phosphate esters, lecithin, copolymers of poly(oxyalkylene) glycols and poly(12-hydroxystearic acid), condensation products of compounds comprising at least one primary amine and poly[alk(en)yl)succinic acid or anhydride, and mixtures thereof.

Among the preferred emulsifying agents are the 2-alkyl and 2-alkenyl-4,4'-bis(hydroxymethyl)oxazolines, the fatty acid esters of sorbitol, lecithin, copolymers of poly(oxyalkylene)glycols and poly(12-hydroxystearic acid), condensation products of compounds comprising at least one primary amine and poly[alk(en)yl]succinic acid or anhydride, and mixtures thereof.

More preferably the emulsifier component comprises a condensation product of a compound comprising at least one primary amine and a poly[alk(en)yl]succinic acid or anhydride. A preferred emulsifier is a polyisobutylene succinic anhydride (PIBSA) based surfactant, which surfactants are described in Canadian Patent No. 1,244,463 (Baker). Australian Patent Application No. 40006/85 (Cooper and Baker) discloses emulsion explosive compositions in which the emulsifier is a condensation product of a poly[alk(en)yl] succinic anhydride and an amine such as ethylene diamine, diethylene triamine and ethanolamine. Further examples of preferred condensation products may be found in Australian Patent Applications Nos. 29933/89 and 29932/89.

Typically, the emulsifier component of the emulsion explosive comprises up to 5% by weight of the emulsion explosive composition. Higher proportions of the emulsifier component may be used and may serve as a supplemental fuel for the composition, but in general it is not necessary to add more than 5% by weight of emulsifier component to achieve the desired effect. Stable emulsions can be formed using relatively low levels of emulsifier component and for reasons of economy, it is preferable to keep to the minimum amounts of emulsifier necessary to achieve the desired effect. The preferred level of emulsifier component used is in the range of from 0.4 to 3.0% by weight of the emulsion explosive.

The surfactant levels used in the manufacture of the emulsion explosive of the present invention can be reduced over the formulations of the shear induced crystallization-resistant formulations typical of the prior art, and may be more typical of the values used for other standard emulsion explosives as described hereinabove.

If desired other, optional fuel materials, hereinafter referred to as secondary fuels, may be incorporated into the emulsion explosives. Examples of such secondary fuels include finely divided solids. Examples of solid secondary fuels include finely divided materials such as: sulfur; aluminum; carbonaceous materials such as gilsonite, comminuted coke or charcoal, carbon black, resin acids such as abietic acid, sugars such as glucose or dextrose and other vegetable products such as starch, nut meal, grain meal and wood-pulp; and mixtures thereof.

The explosive composition is preferably oxygen balanced. This may be achieved by providing a blend of components which are themselves oxygen balanced or by providing a blend which, while having a net oxygen balance, comprises components which are not themselves oxygen balanced. This provides a more efficient explosive composition which, when detonated, leaves fewer unreacted components. Additional components may be added to the explosive composition to control the oxygen balance of the explosive composition.

The explosive composition may additionally comprise a discontinuous gaseous component which gaseous component can be utilized to vary the density and/or the sensitivity of the explosive composition.

The methods of incorporating a gaseous component and the enhanced sensitivity of explosive compositions comprising gaseous components are well known to those skilled in the art. The gaseous components may, for example, be incorporated into the explosive composition as fine gas bubbles dispersed through the composition, as hollow particles which are often referred to as microballons or as microspheres, as porous particles, or mixtures thereof.

A discontinuous phase of fine gas bubbles may be incorporated into the explosive composition by mechanical agitation, injection or bubbling the gas through the composition, or by chemical generation of the gas in situ.

Suitable chemicals for the in situ generation of gas bubbles include peroxides, such as hydrogen peroxide, nitrates, such as sodium nitrate, nitrosoamines, such as N,N'-dinitrosopentamethylenetetramine, alkali metal borohydrides, such as sodium borohydride, and carbonates, such as sodium carbonate. Preferred chemicals for the in situ generation of gas bubbles are nitrous acid and its salts which react under conditions of acid pH to produce gas bubbles. Preferred nitrous acid salts include alkali metal nitrites, such as sodium nitrite. Catalytic agents such as thiocyanate or thiourea may be used to accelerate the reaction of a nitrite gassing agent. Suitable small hollow particles include small hollow microspheres of glass or resinous materials, such as phenol-formaldehyde, urea-formaldehyde and copolymers of vinylidene chloride and acrylonitrile. Suitable porous materials include expanded minerals such as perlite, and expanded polymers such as polystyrene.

In a further aspect, the present invention also provides a pumpable, shear thickenable emulsion explosive comprising a discontinuous phase of an oxidizer salt, and a continuous fuel phase, wherein said fuel phase comprises a vegetable oil. Preferably, the fuel phase comprises at least 30%, and more preferably between 30 and 704, vegetable oil.

In a still further aspect, the present invention also provides a method of blasting comprising placing an explosive initiator such as, for example, a booster, a primer, or a detonator, as appropriate, in operative attachment to an emulsion explosive as described hereinabove, and igniting said initiator.

EXAMPLES

The invention will now be described, by way of example only, by reference to the following examples.

EXAMPLE 1

Emulsion explosive compositions were prepared, for this example and all subsequent examples unless indicated otherwise, by the following technique. A first premix of an oxidizer salt or a mixture of oxidizer salts, in water was heated to above 75° C. until a liquefied solution of the oxidizer salts was obtained. A second premix of organic fuels and emulsifying agent(s) was heated in the bowl of a Hobart mixer to a temperature of 90° C. While mixing the second premix at a moderate speed (Speed 2) in the Hobart mixer, the first premix of the oxidizer salt solution was slowly added and an emulsion explosive formed.

The formulations used to manufacture the emulsion formulations of Example 1 are set out in Table 2.

In order to measure the increase in viscosity caused by shear induced thickening, the various emulsion formulations of Example 1 were mixed at an increased speed (Speed 3) in the Hobart mixer, for various additional mix times, and the viscosity of each emulsion, after the additional mix time, was measured using a Brookfield viscometer (Spindle 6, Speed 10). The results are of the experiments are also set out in Table 2.

TABLE 2

Effect of Shear on Emulsion Explosives

| | Formulation No. | | | |
|---|---|---|---|---|
| | 1 | 2 | 3 | 4 |
| AN/SN Liquor[1] | 93.2 | 93.2 | 93.2 | 92.6 |
| Diesel Oil | 3.7 | 2.7 | 2.7 | — |
| Slack Wax | 1.7 | — | — | — |
| Canola Oil | — | 2.7 | — | — |
| Corn Oil | — | — | 2.7 | 6.0 |
| Sorbitan Monooleate | 1.4 | 1.4 | 1.4 | 1.4 |
| Additional Mix time (sec.) | Viscosity (cps) | | | |
| 0 | 19,000 | 29,000 | 20,000 | 40,000 |
| 30 | 29,000 | 42,000 | 29,000 | a |
| 60 | 35,000 | 49,500 | 45,000 | a |
| 90 | 40,000 | 57,000 | 55,000 | a |
| 150 | 45,000 | 63,000 | 65,000 | a |
| 270 | 56,000 | 82,000 | 75,000 | a |

[1]69% Ammonium nitrate, 15% Sodium nitrate, and 16% water.
a - Viscosity was too high to measure, ie. very thick As can be seen from Table 2, all emulsions, including those such as Formulation 1 which are not in accordance with the present invention, tend to thicken under shear. However, those emulsions which are in accordance with the present invention (Formulations 2, 3 and 4) have a more rapid development of high viscosity, and achieve a higher viscosity. Formulation 4 demonstrates the very high viscosity which can be rapidly achieved using the present invention.

EXAMPLE 2

A series of experiments were conducted on a variety of formulations to determine the effect of various check valve pressures on the rheology of the emulsion. Typically, crystallization of the oxidizer salt phase is more likely to occur as the pumping temperature is decreased. Further, as the oxidizer salt phase crystallizes, the temperature of the emulsion increases. While some increase in temperature can be attributed to the mechanical forces of pumping, the relative increases in temperature between two emulsions is indicative of the degree of crystallization of the emulsion. The formulations of the emulsions used in this example are set out in Table 3.

The emulsions produced from formulations 5 to 11 were pumped at various temperatures and pressures, and passed through check valves set at the different pressures shown in Table 4. The viscosity and temperature of the emulsion after check valve thickening was measured. Further, the blasting characteristics of the emulsions after thickening was measured in order to determine if there was any detrimental effect on the blasting properties of the emulsions.

TABLE 3

| Formulations for Example 2 | | | | | | | |
|---|---|---|---|---|---|---|---|
| | Formulation No. | | | | | | |
| | 5 | 6 | 7 | 8 | 9 | 10 | 11 |
| AN/SN Liquor[1] | 91.5 | 91.5 | 91.0 | 91.0 | 91.5 | 91.4 | 91.3 |
| HT-22[2] | 4.0 | 2.75 | — | — | — | — | — |
| Isopar[3] | — | — | — | — | 4.0 | 3.1 | 2.1 |
| Corn Oil | — | — | 4.5 | 3.25 | — | 1.0 | 2.1 |
| PIBSA based surfactant | 2.0 | 3.0 | 2.0 | 3.0 | 2.0 | 2.0 | 2.0 |
| Sorbitan Monoleate | 0.5 | 0.75 | 0.5 | 0.75 | 0.5 | 0.5 | 0.5 |

[1]69% Ammonium nitrate, 15% Sodium nitrate, and 16% water.
[2]High viscosity mineral oil
[3]Low viscosity paraffin oil

TABLE 4

| PUMPING PRESSURE TESTS[a] | | | | | |
|---|---|---|---|---|---|
| FORMULATION[b] | PUMPING TEMPERATURE (°C.) | PUMPING PRESSURE[c] (psi) | VISCOSITY[d] (cps) | Δ T (°C.) | ϕ[e]/Primer[f]/Velocity[g] ($kms^{-1}$) |
| 5 | 20 | 0 | 60,000 | 0 | 2"/20 g/5.0 |
| | | 100 | X | 15 | 3"/PX/F |
| | | 200 | X | 15 | 3"/PX/F |
| 6 | 20 | 0 | 160,000 | 0 | 2"/20 g/5.0 |
| | | 100 | X | 15 | 3"/PX/F |
| | | 200 | X | 15 | 3"/PX/F |
| | 40 | 0 | 120,000 | 0 | 2"/20 g/5.0 |
| | | 100 | 200,000 | Not measured | 2"/PX/B |
| | | 100 | 200,000 | Not measured | 3"/PX/4.7 |
| | | 200 | 140,000 | Not measured | 3"/PX/F |
| 7 | 30 | 0 | 160,000 | 0 | 2"/60 g/5.0 |
| | | 100 | >400,000 | 4 | 2"/60 g/5.0 |
| | | 200 | >400,000 | 7 | 2"/60 g/5.1 |
| 8 | 30 | 0 | 200,000 | 0 | 2"/20 g/4.7 |
| | | 100 | 360,000 | 0 | 3"/60 g/4.8 |
| | | 200 | >400,000 | 8 | 3"/60 g/4.9 |
| 9 | 15 | 0 | 49,000 | 0 | 2"/20 g/5.0 |
| | | 100 | 190,000 | 4 | 2"/20 g/5.0 |
| | | 200 | 280,000 | 10 | 2"/20 g/5.0 |
| | 60 | 0 | 36,000 | 0 | 2"/20 g/5.0 |
| | | 100 | 132,000 | 0 | 2"/20 g/5.0 |
| | | 200 | 212,000 | 0 | 2"/20 g/5.0 |
| 10 | 14 | 0 | 53,000 | 0 | 2"/20 g/5.0 |
| | | 100 | 240,000 | 2 | 2"/20 g/5.0 |
| | | 200 | >400,000 | 4 | 2"/20 g/5.0 |
| | 60 | 0 | 40,000 | 0 | 2"/20 g/5.0 |
| | | 100 | 150,000 | 0 | 2"/20 g/5.0 |
| | | 200 | 288,000 | 0 | 2"/20 g/5.0 |
| 11 | 7 | 0 | 98,000 | 0 | 2"/20 g/5.0 |
| | | 100 | 350,000 | 0 | 2"/20 g/5.0 |
| | | 200 | >400,000 | 8 | 2"/40 g/4.5 |
| | 40 | 0 | 90,000 | 0 | 2"/20 g/5.0 |
| | | 100 | 360,000 | 0 | 2"/20 g/4.3 |
| | | 200 | >400,000 | 0 | 2"/20 g/3.8 |
| | 75 | 0 | 57,000 | 0 | 2"/20 g/5.0 |
| | | 100 | 340,000 | 0 | 2"/20 g/5.0 |
| | | 200 | >400,000 | 0 | 2"/20 g/5.0 |

[a]Experiments were performed on emulsion batches manufactured on a Gelmaster bowl; mechanical equipment employed consisted of a 4 inch diameter "Powergel" pump, using 3 inches of a 2 or 3 inch diameter hose (zero line pressure) and an adjustable check/relief valve arrangement (spring loaded with an adjustable screw tension)
[b]Formulations as shown in Table 3
[c]Check valve setting
[d]Brookfield viscometer: spindle 7, speed 10 "X" = massive crystallisation
[e]Diameter of hose
[f]Grams of primer used for initiation; PX = Pentomex primer
[g]Velocity of detonation in km/sec
F = failed to detonate
B = burned Formulations 5, 6 and 9 were not prepared in accordance with the present invention, while formulations 7, 8, 10 and 11 were prepared in accordance with the present invention.

It can be seen from Table 4 that, under similar conditions, the viscosity of the emulsions of the present invention were greater after check valve thickening than the viscosities of the formulations not in accordance with the present invention. Further, the viscosity of formulations 7, 8, 10 and 11 were, under certain conditions, greater than 400,000 cps. which value was not obtained for the emulsions not in accordance with the present invention.

The temperature increase, which can be considered to be an indication of the degree of crystallization of the shear thickened emulsion, is greater for the emulsions not in accordance with the present invention, and ranged anywhere from 4° to 15° C., while the emulsions in accordance with the present invention increased in temperature by a maximum of 8° C. and only then under conditions of low or ambient temperature and high shear (200 psi), conditions under which maximum crystallization would normally be expected. This reduced tendency to crystallize, in combination with significantly increased viscosity, provides an improved emulsion explosive through the use of corn and/or other vegetable oils in accordance with the present invention. Thus, it is believed that less crystallization of the emulsions in accordance with the present invention has occurred. Further, massive crystallization of the emulsion was observed with formulations 5 and 6 after shear thickening was conducted.

Blasting results obtained on 2 and 3 inch diameter cartridges of the shear thickened emulsions made under the conditions shown in Table 4 are also shown. All formulations made in accordance with the present invention detonated and provided velocity of detonation (VOD) values of greater than 3.8 km/sec, and typically greater than 4.7 km/sec. The emulsions prepared from formulations not in accordance with the present invention frequently failed to detonate, or merely burned rather than detonate.

Accordingly, it can be seen that increased viscosity and increase resistance to shear induced crystallization of the oxidizer salt can be achieved by the method of the present invention.

Having described specific embodiments of the present invention, it will be understood that modification thereof may be suggested to those skilled in the art, and it is intended to cover all such modifications as fall within the scope of the appended claims.

We claim:

1. A method for producing an emulsion explosive having a viscosity greater than 240,000 cps and which is essentially free from high shear induced crystallization, comprising:

i) preparing a melt or aqueous phase solution of an oxidizer salt;

ii) forming a liquid, water-immiscible, organic fuel phase which comprises at least about 15% vegetable oil;

iii) mixing said oxidizer salt melt or solution into said organic fuel phase such that said oxidizer salt melt or solution forms a discontinuous phase in said fuel phase and thus forms an emulsion explosive premix; and iv) subjecting said emulsion explosive premix to a pumping pressure of greater than about 100 psi to induce shear thickening of said premix.

2. A method as claimed in claim 1 wherein said emulsion explosive premix is subjected to a pumping pressure of greater than about 200 psi and said emulsion explosive has a viscosity of at least 400,000 cps.

3. A method as claimed in claim 1 wherein at least 30% of said fuel phase is a vegetable oil.

4. A method as claimed in claim 1 wherein said vegetable oil is selected from the group consisting of corn oil, canola oil, soya oil, sunflower oil, linseed oil, peanut oil, and safflower oil, or mixtures thereof.

5. A method as claimed in claim 1 wherein between 30 and 70% of said fuel phase is a vegetable oil.

* * * * *